US008284213B2

(12) United States Patent
Inamoto et al.

(10) Patent No.: US 8,284,213 B2
(45) Date of Patent: Oct. 9, 2012

(54) DISPLAY CONTROL APPARATUS AND DISPLAY CONTROL METHOD

(75) Inventors: Shinji Inamoto, Tokyo (JP); Hiroaki Toriumi, Tokyo (JP)

(73) Assignee: Sony Corporation, Tokyo (JP)

( * ) Notice: Subject to any disclaimer, the term of this patent is extended or adjusted under 35 U.S.C. 154(b) by 1468 days.

(21) Appl. No.: 11/519,881

(22) Filed: Sep. 13, 2006

(65) Prior Publication Data

US 2007/0064017 A1 Mar. 22, 2007

(30) Foreign Application Priority Data

Sep. 22, 2005 (JP) ..... 2005-275340

(51) Int. Cl.
*G09G 5/00* (2006.01)

(52) U.S. Cl. ..... 345/619; 345/536

(58) Field of Classification Search ..... 345/619, 345/536

See application file for complete search history.

(56) References Cited

U.S. PATENT DOCUMENTS 6,734,873 B1 * 5/2004 Herf et al. ..... 345/629
2004/0239690 A1 * 12/2004 Wyatt et al. ..... 345/649

FOREIGN PATENT DOCUMENTS

JP 10-198338 7/1998
JP 2002-268867 9/2002
JP 2003-224783 8/2003

OTHER PUBLICATIONS

Japanese Office Action issued Aug. 18, 2011, in Patent Application No. 2005-275340.
Office Action issued Jun. 22, 2012, in European Application No. 06019685.4.
Office Action issued Jun. 19, 2012, in Japanese Patent Application No. 2005-275340, filed Sep. 22, 2005, 3 pages.

* cited by examiner

*Primary Examiner* — Maurice L McDowell, Jr.
(74) *Attorney, Agent, or Firm* — Oblon, Spivak, McClelland, Maier & Neustadt, L.L.P.

(57) ABSTRACT

A display control apparatus and method is disclosed wherein the amount of use of a memory to be used to store an image to be displayed can be reduced. The display control apparatus has an execution section, a first retaining section, an image processing section, a second retaining section and reflect section. The image processing section and the first and second retaining sections being controlled with an application program interface provided by the middleware and called by the application program. In addition, a display control method for a display control apparatus which causes an image corresponding to image data to be displayed on a display unit, including a first retaining step, an image processing step, and a reflection step.

9 Claims, 8 Drawing Sheets

FIG. 3

| | |
|---|---|
| API A,<br>INITIALIZATION OF BACK BUFFER | Aa IDENTIFICATION INFORMATION FRONT BUFFER<br>Ab LOGICAL WIDTH OF BACK BUFFER<br>Ac LOGICAL HEIGHT OF BACK BUFFER<br>Ad ROTATIONAL ANGLE (0°, 90°, 180°, 270°)<br>Ae WHETHER OR A PARTIAL BACK BUFFER IS PERMITTED<br>Af SIZE OF PARTIAL BACKUP BUFFER |
| API B,<br>ENDING PROCESS FOR BACK BUFFER | |
| API C,<br>PARAMETER VARIATION OF BACK BUFFER | |
| API D,<br>UPDATING INFORMATION ACQUISITION OF FRONT BUFFER | Da IDENTIFICATION INFORMATION OF FRONT BUFFER<br>Db RECTANGULAR REGION TO BE UPDATED (COORDINATES, WIDTH AND HEIGHT IN BACK BUFFER)<br>DC POINTER TO REGION INTO WHICH UPDATING INFORMATION IS TO BE STORED |
| API E,<br>UPDATING OF FRONT BUFFER | Ea IDENTIFICATION INFORMATION OF FRONT BUFFER<br>Eb RECTANGULAR REGION TO BE UPDATED (COORDINATES, WIDTH AND HEIGHT IN BACK BUFFER) |

DISPLAY CONTROL APPARATUS AND DISPLAY CONTROL METHOD

CROSS REFERENCES TO RELATED APPLICATIONS

The embodiment of the present invention contains subject matter related to Japanese Patent Application JP 2005-275340 filed with the Japanese Patent Office on Sep. 22, 2005, the entire contents of which being incorporated herein by reference.

BACKGROUND OF THE INVENTION

1. Field of the Invention

This invention relates to a display control apparatus and a display control method, and more particularly to a display control apparatus and a display control method suitable for use where display of a display unit is updated by updating image data placed in a back buffer into a front buffer in a VRAM (Video Random Access Memory).

2. Description of the Related Art

Drawing of an image on a display unit is performed such that image data are drawn in a buffer provided in a VRAM and the stored substance of the VARM is reflected on the display unit. Accordingly, if the timing at which the substance of the VRAM is reflected at an inappropriate timing, then an incomplete image corresponding to image data during drawing in the VRAM may be displayed on the display unit.

An exemplary apparatus which prevents such a situation as described above is disclosed, for example, in Japanese Patent Laid-Open No. Hei 8-50659 and is shown in FIG. 1. Referring to FIG. 1, a first buffer 2 and a second buffer 3 of an equal size are provided in a VRAM 1. One of the first and second buffers 2 and 3 is used for drawing of image data while the other is used for reflection on a display unit 4. Further, the uses of the first and second buffers 2 and 3 are changed over alternately.

Also another apparatus is known wherein a front buffer is provided in a VRAM while a back buffer is provided in a main memory. The back buffer is used for drawing of image data while the front buffer is used for reflection on a display unit, and the stored substance of the back buffer is transferred rapidly to the front buffer.

SUMMARY OF THE INVENTION

In both apparatus, it is necessary to provide, in a VRAM or a main memory, a drawing buffer having a size equal to that of a reflection buffer on the display unit provided in the VRAM. However, it is sometimes difficult to assure the drawing buffer from a restriction of the system.

In an embodiment of the present invention, it is desirable to provide a display control apparatus and a display control method by which the used amount of a memory for storing image data to be displayed as an image can be reduced.

According to an embodiment of the present invention, there is provided a display control apparatus for causing an image corresponding to image data to be displayed on a display unit, including an execution section configured to execute an application program and middleware for controlling action of the display control apparatus, a first retaining section configured to retain inputted image data, an image processing section configured to perform an image process for image data read out from the first retaining section, a second retaining section configured to retain image data of a result of the image process by the image processing section, and a reflection section configured to reflect the image data retained in the second retaining section on display of the display section, the image processing section and the first and second retaining sections being controlled with an application program interface provided by the middleware and called by the application program.

The image processing section may perform at least one of an expansion process, a reduction process and a rotation process for the image data read out from the first retaining section.

The image processing section may calculate an expansion ratio for the expansion process or a reduction ratio for the reduction process based on sizes of the first and second retaining sections.

The image processing section may perform the image process for the image data read out partly from the first retaining section.

In this instance, a boundary of the image data read out partly from the first retaining section may be determined in such a manner as to have integer coordinate values after the image process by the image processing section. With the display control apparatus, otherwise possible displacement of the expansion ratio or reduction ratio can be eliminated to prevent deterioration of the picture quality.

Alternatively, a boundary of the image data read out partly from the first retaining section may be determined taking a filtering process of pixels included in the image process by the image processing section into consideration.

The first retaining section may have a capacity smaller than the amount of the entire image data to be retained and retains the image data inputted divisionally from among the entire image data.

According to another embodiment of the present invention, there is provided a display control method for a display control apparatus which causes an image corresponding to image data to be displayed on a display unit, including a first retaining step of retaining inputted image data, an image processing step of reading out the image data retained by the process at the first retaining step and performing an image process for the image data, a second retaining step of retaining image data of a result of the image process by the process at the image processing step, and a reflection step of reflecting the image data retained by the process at the second retaining section on display of the display section, the image processing step and the first and second retaining steps being controlled with an application program interface provided by middleware and called by an application program.

In the display control method, the process of reading out the retained image data and performing the image process for the image data and the process of retaining image data of a result of the image process are controlled by the API provided by the middleware and called by the application program.

With the display control apparatus and the display control method, the used amount of the memory for storing image data to be displayed as an image can be reduced without deteriorating the picture quality.

The above and other objects, features and advantages of the present invention will become apparent from the following description and the appended claims, taken in conjunction with the accompanying drawings in which like parts or elements denoted by like reference characters.

BRIEF DESCRIPTION OF THE DRAWINGS

FIG. 3 is a view illustrating APIs provided by buffer control middleware shown in FIG. 2;

DETAILED DESCRIPTION OF THE PREFERRED EMBODIMENTS

Figure 1:
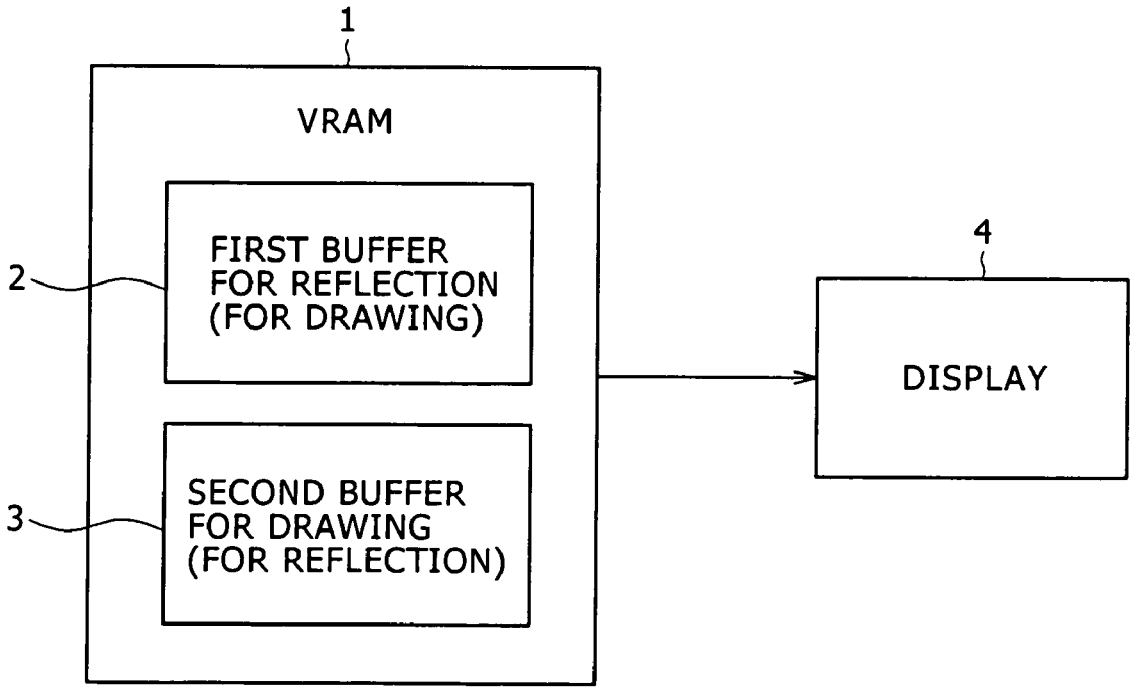
FIG. 1 is a block diagram illustrating a method of preventing an incomplete image from being displayed on a display unit.

Before a preferred embodiment of the present invention is described in detail, a corresponding relationship between several features recited in the accompanying claims and particular elements of the preferred embodiment described below is described. The description, however, is merely for the confirmation that the particular elements which support the invention as recited in the claims are disclosed in the description of the embodiment of the present invention. Accordingly, even if some particular element which is recited in description of the embodiment is not recited as one of the features in the following description, this does not signify that the particular element does not correspond to the feature. On the contrary, even if some particular element is recited as an element corresponding to one of the features, this does not signify that the element does not correspond to any other feature than the element.

According to an embodiment of the present invention, there is provided a display control apparatus (for example, an image display apparatus 10 of FIG. 2) for causing an image corresponding to image data to be displayed on a display unit, including an execution section (for example, a CPU 11 shown in FIG. 2) configured to execute an application program (for example, an image display application 31 illustrated in FIG. 2) and middleware (for example, buffer control middleware 32 illustrated in FIG. 2) for controlling action of the display control apparatus, a first retaining section (for example, a back buffer 34 shown in FIG. 2) configured to retain inputted image data, an image processing section (for example, an image processing section 41 shown in FIG. 2) configured to perform an image process for image data read out from the first retaining section, a second retaining section (for example, a front buffer 43 shown in FIG. 2) configured to retain image data of a result of the image process by the image processing section, and a reflection section (for example, a display control section 17 shown in FIG. 2) configured to reflect the image data retained in the second retaining section on display of the display section, the image processing section and the first and second retaining sections being controlled with an application program interface provided by the middleware and called by the application program.

According to another embodiment of the present invention, there is provided a display control method for a display control apparatus which causes an image corresponding to image data to be displayed on a display unit, including a first retaining step (for example, a step S1 illustrated in FIG. 4) of retaining inputted image data, an image processing step (for example, a step S4 illustrated in FIG. 4) of reading out the image data retained by the process at the first retaining step and performing an image process for the image data, a second retaining step (for example, a step S5 illustrated in FIG. 4) of retaining image data of a result of the image process by the process at the image processing step, and a reflection step (for example, a step S6 illustrated in FIG. 4) of reflecting the image data retained by the process at the second retaining section on display of the display section, the image processing step and the first and second retaining steps being controlled with an application program interface provided by middleware and called by an application program.

Now, a particular embodiment wherein the present invention is applied is described in detail with reference to the accompanying drawings.

Figure 2:
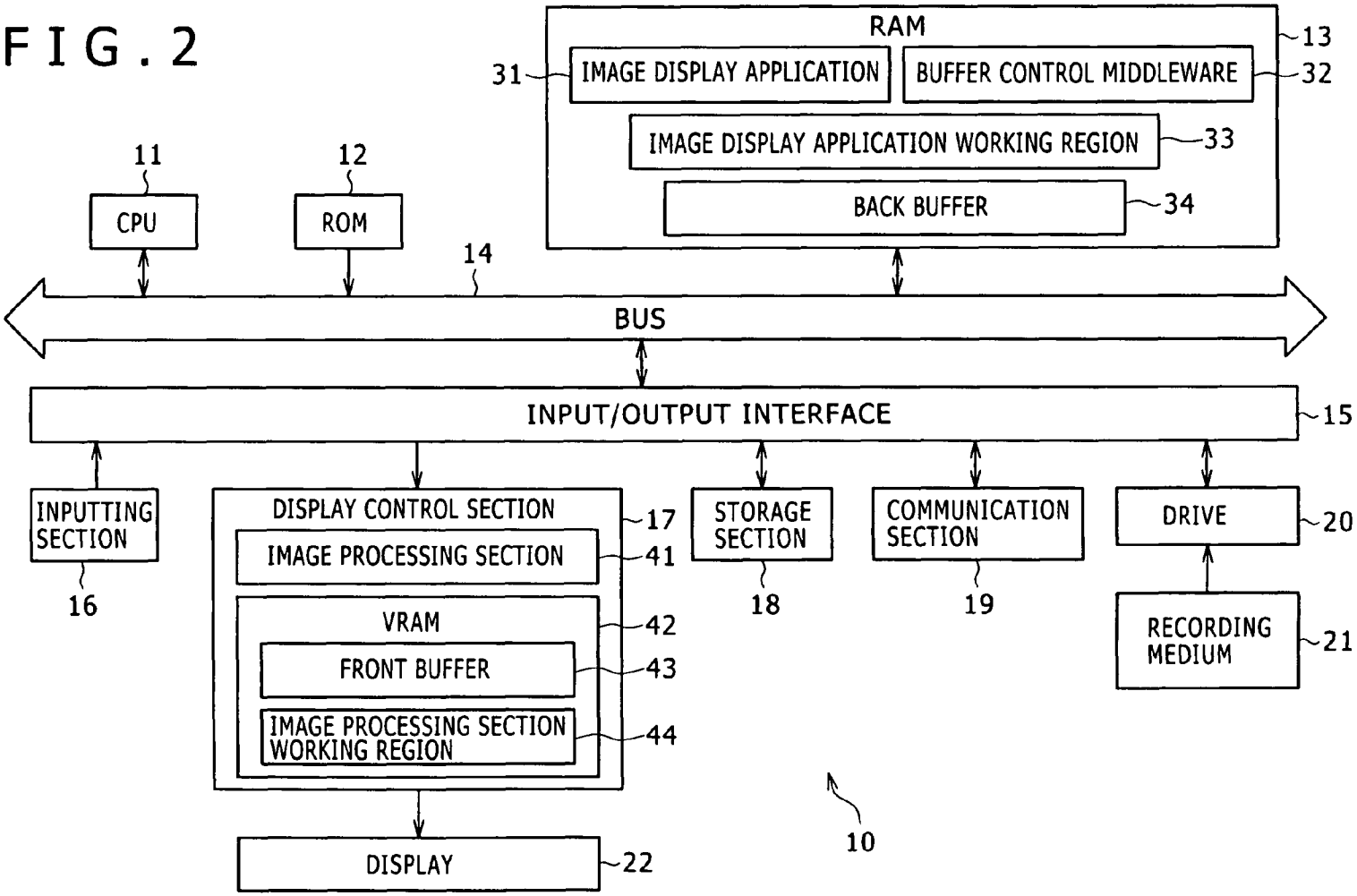
FIG. 2 is a block diagram showing an example of a configuration of an image display apparatus to which an embodiment of the present invention is applied.

FIG. 2 shows an example of a configuration of an image display apparatus to which an embodiment of the present invention is applied. Referring to FIG. 2, the image display apparatus 10 expands or reduces and/or rotates, or extracts part of, for example, image data supplied thereto from the outside through a recording medium 21 or image data produced by an image production application. Then, the image display apparatus 1 displays resulting data on a display unit 22.

The image display apparatus 10 has a central processing unit (CPU) 11 built therein. An input/output interface 15 is connected to the CPU 11 through a bus 14. A read-only memory (ROM) 12 and a random access memory (RAM) 13 are connected to the bus 14.

An inputting section 16, a display control section 17, a storage section 18, and a communication section 19 are connected to the input/output interface 15. The inputting section 16 is configured so as to be operated by a user to input an operation command. The display control section 17 controls the display unit 22 at the succeeding stage to display image data. The storage section 18 is formed from a hard disk drive and used to store a program and various data. The communication section 19 is formed from a modem, a local area network (LAN) adapter or the like and executes a communication process through a network represented by the Internet. Also a drive 20 for writing and reading out data on and from the recording medium 21 is connected to the input/output interface 15. The recording medium 21 may be a magnetic disk (including a flexible disk), an optical disk (including a CD-ROM (Compact Disk-Read Only Memory) and a DVD (Digital Versatile Disk)), a magneto-optical disk (including an MD (Mini Disc)), or a semiconductor memory.

An image display application 31 to be executed by the CPU 11 and buffer control middleware 32 are stored in the RAM 13. The buffer control middleware 32 provides a plurality of application program interfaces (APIs) to be called from the image display application 31. The image display application 31 and the buffer control middleware 32 are installed in the storage section 18 and loaded from the storage section 18 into the RAM 13 in accordance with an instruction of the CPU 11 corresponding to a command from the user inputted to the inputting section 16.

Further, an image display application working region 33 for being used by the image display application 31 and a back buffer 34 for storing image data read out from the recording medium 21 are provided in the RAM 13.

The display control section 17 includes an image processing section 41 which performs expansion or reduction and/or rotation and so forth for image data retained in the back buffer 34, and a VRAM 42. A front buffer 43 into which image data to be reflected on the display unit 22 are written and an image processing section working region 44 for being used by the image processing section 41 are provided in the VRAM 42.

Now, four different APIs which are provided by the buffer control middleware 32 and called by the image display application 31 are described with reference to FIG. 3.

The API A is for assuring a memory region for the back buffer 34 in the RAM 13 based on arguments hereinafter described to initialize management information of the back buffer 34. The image display application 31 designates, as the arguments, identification information (argument Aa) of the front buffer 43, a logical width (argument Ab) of the back buffer 34, a logical height (argument Ac) of the back buffer 34, a rotational angle (argument Ad) of 0°, 90°, 180° or 270°, whether or a partial back buffer hereinafter described is permitted (argument Ae) and a size (argument Af) of the partial backup buffer.

The API B is for releasing a memory region of the back buffer 34 assured on the RAM 13 to clear the assured management information of the back buffer 34.

The API C is for varying the management information of the back buffer 34 initialized by the API A.

The API D is for using a partial back buffer to acquire information necessary to update the front buffer 43, that is, to transfer image data of the back buffer 34 to the front buffer 43. Where it is set that, when initialization is performed by the API A, the partial back buffer is not used, there is no need to call the API D. The image display application 31 designates, as arguments, identification information of the front buffer 43 (argument Da), a rectangular region to be updated (coordinates, width and height in the back buffer 34) (argument Db) and a pointer to a region into which update information is to be stored (argument Dc).

The image display application 31 can acquire the following information Ia to Ie from the API D:

information Ia; top address of the partial back buffer region, information Ib; maximum value region_height hereinafter described of the height of a divisional region;

information Ic; data size row_bytes hereinafter described of one line of the designated region;

information Id; information for the identification of a third extension region hereinafter described; and information Ie; height vertical_region hereinafter described of an extension portion for allowing divisional updating.

The image display application 31 can grasp a region which becomes an updating object region depending upon an API E hereinafter described based on the information Ia to Ie acquired from the API D and can update image data of the partial back buffer.

The API E is for updating the front buffer 43 based on arguments specified below. The image display application 31 designates identification information of the front buffer 43 as an argument Ea and a rectangular region, that is, the coordinate values, width and height of the rectangular region, in the back buffer 34, to be updated as an argument Eb.

It is to be noted that the API A described hereinabove presupposes that necessary information regarding the front buffer 43 can be acquired through different middleware based on the identification information of the front buffer 43. The necessary information here is the width, the height, the address of a region for storing image data and so forth. Where the different middleware is not available, the arguments of the API A are added so that the image display application 31 may designate also the necessary information regarding the front buffer 43 such as the width, the height, the address of a region for storing image data and so forth.

Further, it is assumed that the front buffer 43 and the back buffer 34 are managed independently of each other, and the buffer control middleware 32 does not manage the front buffer 43. However, the buffer control middleware 32 may otherwise manage the front buffer 43.

Figure 4:
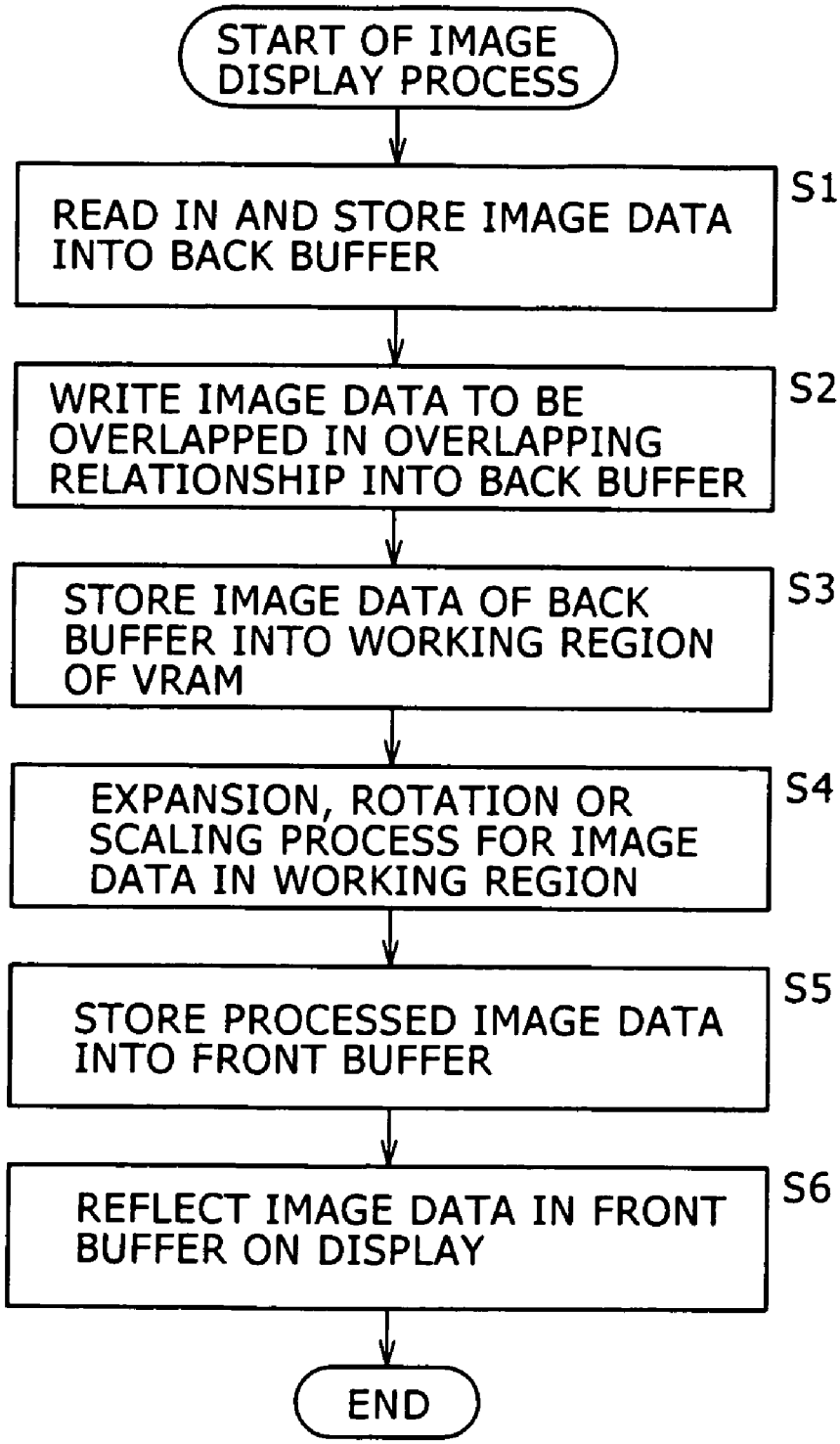
FIG. 4 is a flow chart illustrating an outline of action of the image display apparatus.

Now, an outline of action of the image display apparatus 10 is described with reference to a flow chart of FIG. 4. At step S1, the image display application 31 calls the API A to initialize the back buffer 34 and reads out and stores image data from a recording medium 21 loaded in the drive 20 into the back buffer 34. Where some other image data are to be displayed in an overlapping relationship with the read out image data, the image display application 31 utilizes the image display application working region 33 to produce overlapping image data and writes the overlapping image data in an overlapping relationship on the image data of the back buffer 34 at step S2.

At step S3, the image display application 31 calls the API E and issues a request to the buffer control middleware 32 to update the image data in the back buffer 34 into the front buffer 43. In accordance with the request, the buffer control middleware 32 stores the image data in the back buffer 34 into the image processing section working region 44. At step S4, the image processing section 41 performs an expansion process or a reduction process and/or a rotation process for the image data stored in the image processing section working region 44 based on the information set through the API A. At step S5, the image processing section 41 stores the image data for which the expansion process and so forth have been performed into the front buffer 43. Then at step S6, the display control section 17 causes the image data in the front buffer 43 to be reflected on the display unit 22.

The description of an outline of action of the drive 20 is such as given above. As can be recognized from the foregoing description, according to the image display apparatus 10, the image display application 31 can execute updating of the front buffer 43 and reflection on the display unit 22 without directly issuing an instruction by calling the API E. Consequently, an incomplete image can be prevented from being displayed on the display unit 22.

Now, expansion, reduction, rotation or region designation updating executed in the process wherein the API E is called and image data are updated from the back buffer 34 into the front buffer 43 is described.

Expansion or Reduction

Where the logical width and height of the back buffer 34 designated with the arguments Ab and Ac of the API A are different from those of the front buffer 43, the image data in the back buffer 34 are expanded or reduced and then updated into the front buffer 43.

Figures 5A, 5B, 5C, 5D:
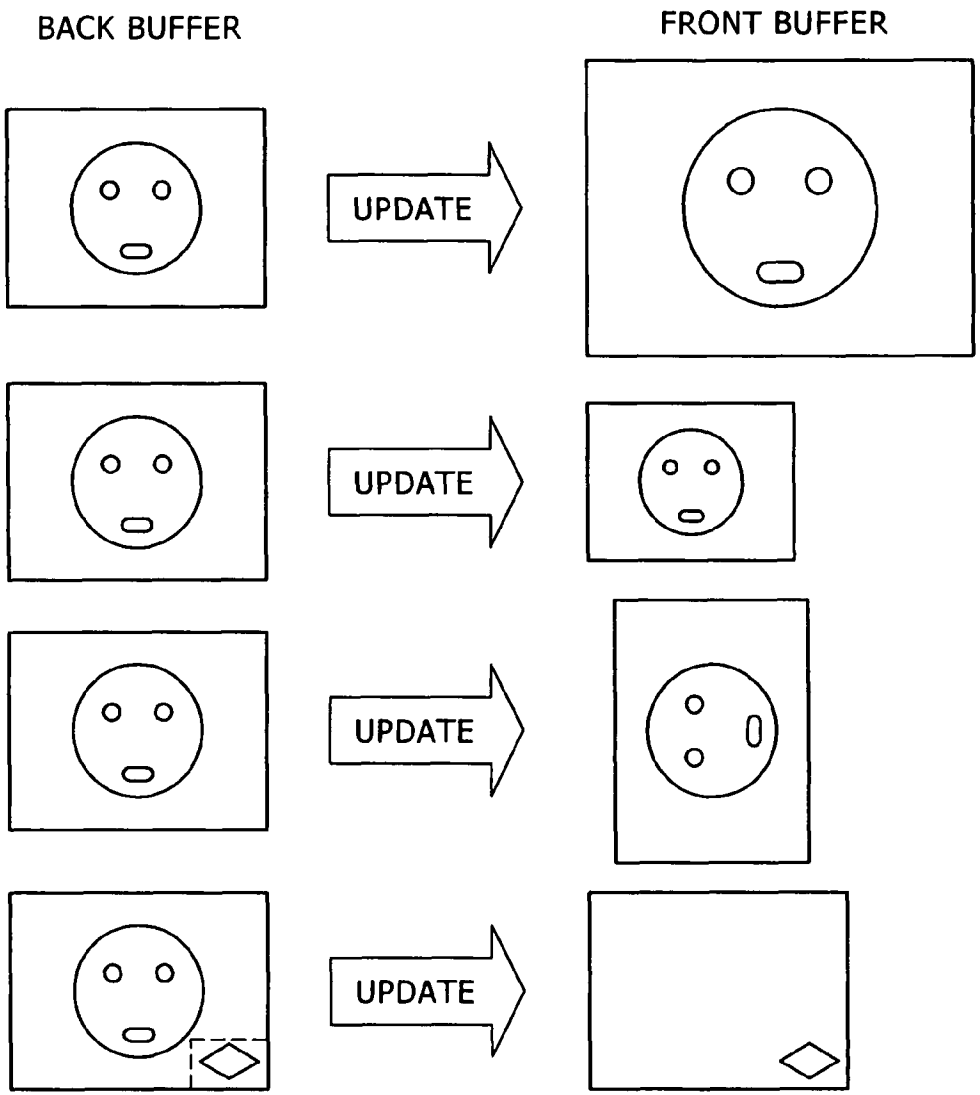
FIGS. 5A to 5D are diagrammatic views illustrating enlargement, reduction, rotation and region designation updating of image data, respectively.
Figures 6A, 6B, 6C:
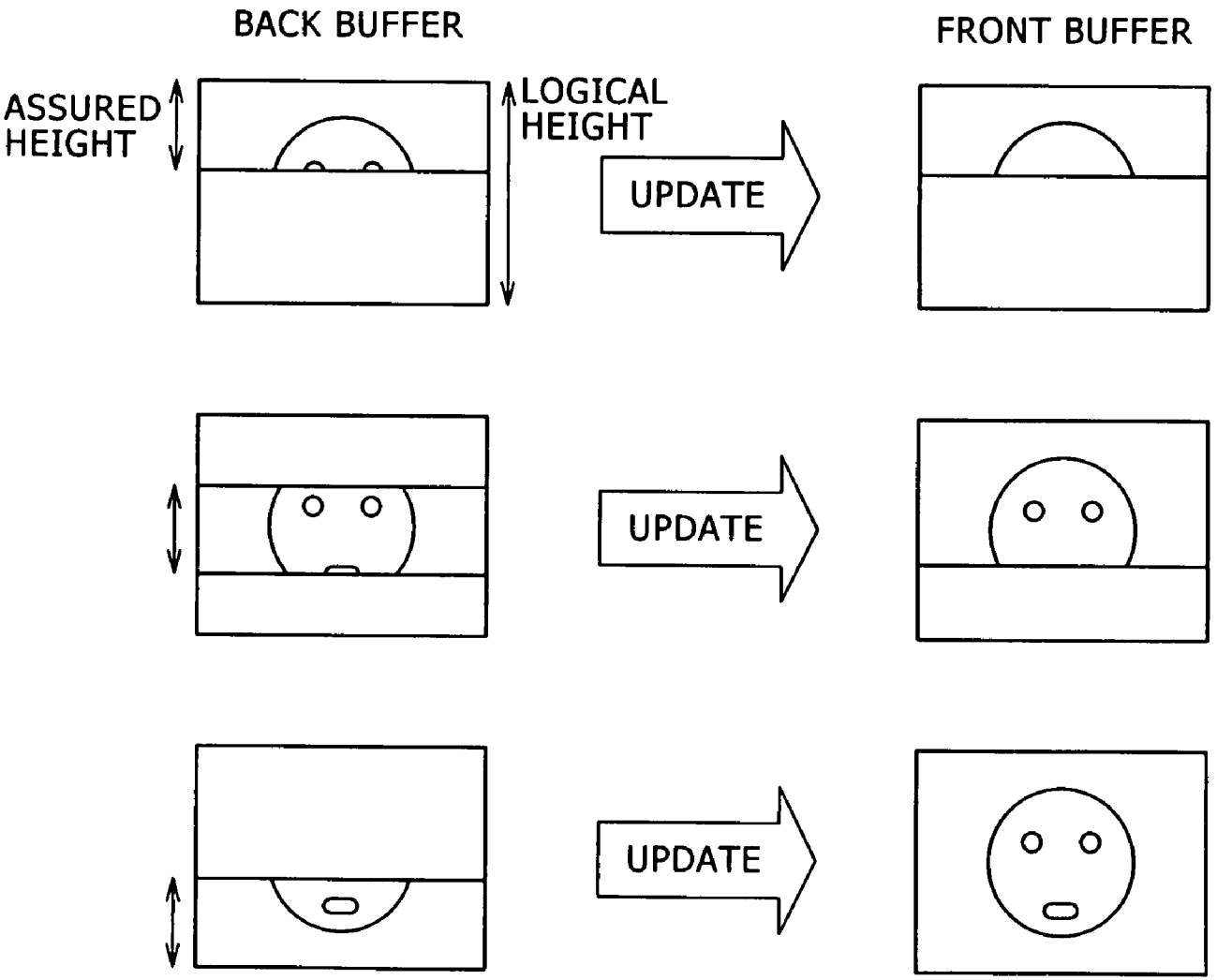
FIGS. 6A to 6C are schematic views illustrating a partial back buffer and divisional updating.

For example, if the logical width and height of the back buffer 34 are smaller than those of the front buffer 43, then the image data of the back buffer 34 are expanded and then updated into the front buffer 43 as seen in FIG. 5A.

On the other hand, for example, if the logical width and height of the back buffer 34 are larger than those of the front buffer 43, then the image data of the back buffer 34 are reduced and then updated into the front buffer 43 as seen in FIG. 5B.

Accordingly, the size of an image to be displayed on the display unit 22 can be varied by varying the width and the height of the front buffer 43 by means of the image display application 31. The expansion ratio or reduction ratio depends upon the width and the height of the back buffer 34 and the width and the height of the front buffer 43, and therefore, the expansion ratio or reduction ratio varies in response to the variation of the width and the height of the front buffer 43.

Therefore, every time the front buffer 43 is updated, the width and the height of the front buffer 43 are acquired and the expansion ratio or reduction ratio is calculated. Consequently, even if the width and the height of the front buffer 43 are varied, when the front buffer 43 is updated, the expansion ratio or reduction ratio can be determined from the width and the height of the front buffer 43 and the width and the height of the front buffer 43 at the point of time. Accordingly, even if the width and the height of the front buffer 43 are varied, there is no necessity to vary the setting of the back buffer 34, and the front buffer 43 can be updated in a similar manner as that before the variation.

Rotation

Where the rotational angle designated by the argument Ad of the API A is any other than 0°, the image data in the back buffer 34 are rotated and updated into the front buffer 43.

For example, where the rotational angle is 90°, the image data of the back buffer 34 are rotated by 90° as seen in FIG. 5C and updated into the front buffer 43.

It is to be noted that the expansion or reduction and the rotation of the image data of the back buffer 34 may be combined.

Region Designation Updating

The region of the front buffer 43 corresponding to a rectangular region to be updated which is designated by the argument Db of the API D or a rectangular region to be updated which is designated by the argument Eb of the API E is updated.

For example, if a region indicated by a broken line in FIG. 5D is designated as the rectangular region to be updated, then only the image data within the region of the broken line are updated into the front buffer 43. It is to be noted that, where expansion or reduction is involved, image data within a predetermined region protruding from the region of the broken line are updated into the front buffer 43 in order to prevent otherwise possible image deterioration.

Since only a designated region can be updated into the front buffer 43 in this manner, the processing efficiency in updating can be enhanced.

It is to be noted that also it is possible to combine the region designation updating, the expansion or reduction, and the rotation.

Partial Back Buffer

Now, a state wherein only a region smaller than the logical size, that is, a region smaller than the size of image data to be displayed, can be assured in the back buffer 34 is described. It is to be noted that the back buffer in the state described is hereinafter referred to as partial back buffer.

Where the argument Ae of the API A is set so as to use a partial back buffer, a partial back buffer is used and the size thereof is assured in accordance with the argument Af. It is to be noted that, where the argument Ae of the API A is set so as not to use a partial back buffer, the argument Af is ignored.

Use of a partial back buffer can reduce the use amount of the main memory, that is, the RAM 13.

Divisional Updating

Where a partial back buffer is used, the API D is called and information for updating the front buffer is acquired. It can be decided based on the acquired information whether or not it is necessary to divisionally update the front buffer. Where the size of the partial back buffer is sufficiently larger than the size of the region to be updated, there is no necessity to divide the front buffer, but the front buffer can be updated by a single updating operation. Where divisional updating is to be performed, only those of image data to be displayed which are of an amount sufficient to be accommodated in the partial back buffer are written into the partial back buffer. Then, the API E is called and updated into the front buffer 43. The series of operations described is repeated.

Region Expansion for Allowing Use of Integer Coordinates

Where the region designation updating and the expansion or reduction are combined, the coordinates after the expansion or reduction process may not indicate integers depending upon the expansion or reduction ratio and the coordinates of the designated region. If fractions of the non-integral coordinates are rounded, then the expansion or reduction ratio is displaced, resulting in deterioration of the picture quality.

For example, it is assumed that, as seen in FIG. 7A, the size of the back buffer 34 has a width of 400 and a height 200 and the size of the front buffer 43 has a width of 500 and a height of 300 and besides the rectangular region to be updated has coordinates of (298, 99), a width of 102 and a height of 101. In this instance, the fractions of the coordinates are rounded in the following manner:

$$298\times500/400=372.5\rightarrow372$$

$$99\times300/200=148.5\rightarrow148$$

Consequently, the vertex of the rectangular region is displaced to (372, 148) of the front buffer 43, and therefore, the expansion or reduction ratio is displaced, resulting in deterioration of the picture quality.

Figure 7:
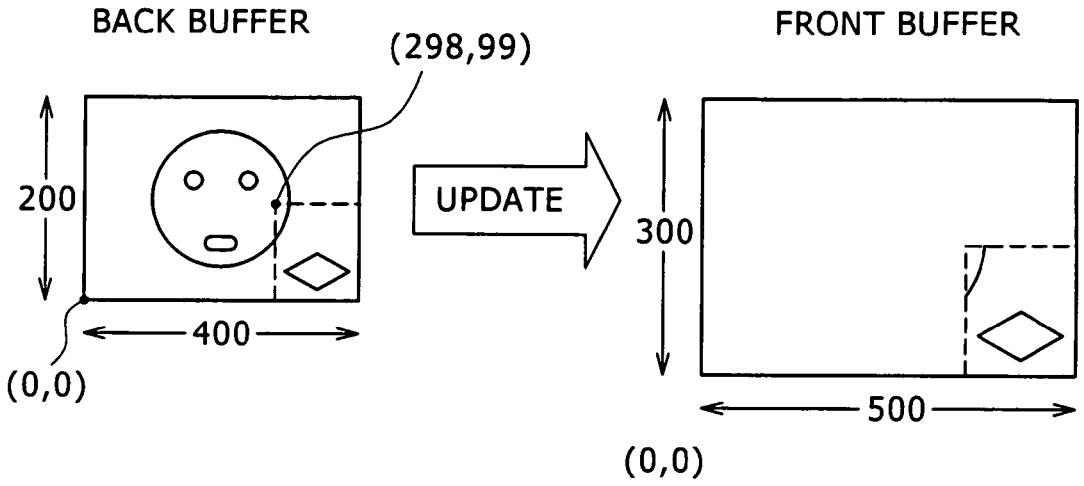
FIG. 7 is a diagrammatic view illustrating a combination of expansion and region designation updating.
Figure 8:
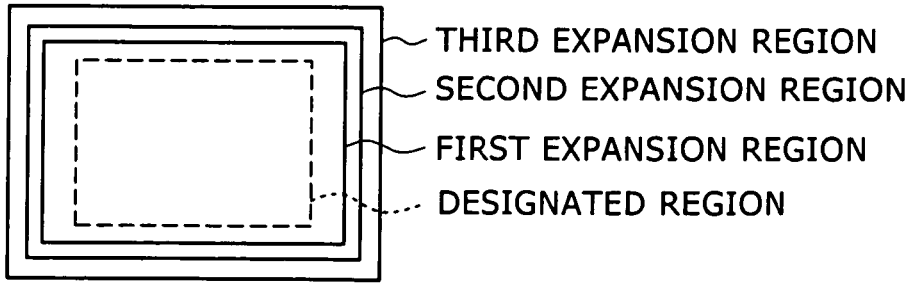
FIG. 8 is a schematic view showing a designation region and first to third expansion regions.

Therefore, in the present embodiment, in order to prevent such displacement of the expansion or reduction ratio, the designated rectangular region as a designated region is extended to a first extension region shown in FIG. 8 so that the coordinates after transfer may become integers. For example, in FIG. 7, the rectangular region to be updated is extended to a region of coordinate values of (298−2, 99−1), a width of 102+2 and a height of 101+1.

As a result of the expansion, the coordinates after transfer become integers as given below:

$$(298-2)\times500/400=370$$

$$(99-1)\times300/200=147$$

Consequently, the expansion or reduction ratio does not exhibit any displacement, and therefore, otherwise possible deterioration of the picture quality can be suppressed.

General formulae for region expansion for allowing use of integer coordinates are given below. It is to be noted here that the width and the height with reference to which expansion is performed are represented by align_x and align_y, respectively.

The region is expanded so that the coordinates of the vertices of the first expansion region satisfy the following conditions 1 and 2.

Condition 1: the x coordinate is a positive integer multiple of align_x or 0.

Condition 2: the y coordinate is a positive integer multiple of align_y or 0.

Then, align_x and align_y are calculated:

align_x=back_w/gcd_w align_y=back_h/gcd_h

The following definitions are applied to the terms in the formulae above:

back_w: logical width of the back buffer back_h: logical height of the back buffer front_w: width of the front buffer front_h: height of the front buffer Where the rotational angle is 0° or 180° gcd_w: greatest common measure of back_w and front_w gcd_h: greatest common measure of back_h and front_h Where the rotational angle is 90° or 270° gcd_w: greatest common measure of back_w and front_h gcd_h: greatest common measure of back_h and front_w It is to be noted that, depending upon the pixel format of the image data, both of the back buffer 34 and the front buffer 43 have a restriction that the x coordinates of all vertices of a rectangle of an object region must be even numbers. In this instance, align_x and align_y are calculated in the following manner so that the x coordinates may be even numbers without fail.

```
Where the rotational angle is 0° or 180°,
    align_y = back_h/gcd_h
    where align_x or (align_x·front_w/back_w) is
an odd number,
        align_x = 2(back_w/gcd_w)
    in any other case
        align_x = back_w/gcd_w
Where the rotational angle is 90° or 270°,
    align_x = back_w/gcd_w
    where align_y or (align_y·front_w/back_h) is
an odd number,
        align_y = 2(back_h/gcd_h)
    in any other case
        align_y = back_h/gcd_h
```

Region Expansion for Allowing Use of a Filtering Process

Incidentally, where expansion or reduction is involved, each pixel after transfer is produced by interpolation (filtering processing) in which pixels which exist upwardly, downwardly, leftwardly and rightwardly in the proximity of the pixel before the transfer are used. Where a pixel on a boundary of a rectangular region to be updated in the region designation is to be interpolated by a filtering process, if information of pixels outside the rectangular region is not available, then the filtering process cannot be preformed appropriately. Therefore, the picture quality is deteriorated around the boundary.

Thus, in the present embodiment, in order to prevent picture quality deterioration in the proximity of a boundary by a filtering process, the first expansion region described hereinabove is further increased by a predetermined expansion width and a predetermined expansion height to set a second expansion region as seen in FIG. 8.

For example, where the expansion width is 4 and the expansion height is 2 in FIG. 7, the first expansion region described hereinabove is expanded to a second expansion region having coordinates of (298−2−4, 99−1−2), a width of 102+2+4 and a height of 101+1+2.

Furthermore, region expansion for allowing use of integer coordinates is performed for the second expansion region to set a third expansion region.

Those image data which belong to the third expansion region set in this manner are transferred from the back buffer 34 to the image processing section working region 44. Those of the image data belonging to the third expansion region which are positioned on the outer side of the first expansion region are used only for the filtering process but are not updated into the front buffer 43. In other words, only those image data on the inner side of the first expansion region are updated into the front buffer 43.

Region Expansion for Allowing Use of Divisional Updating

Figure 9:
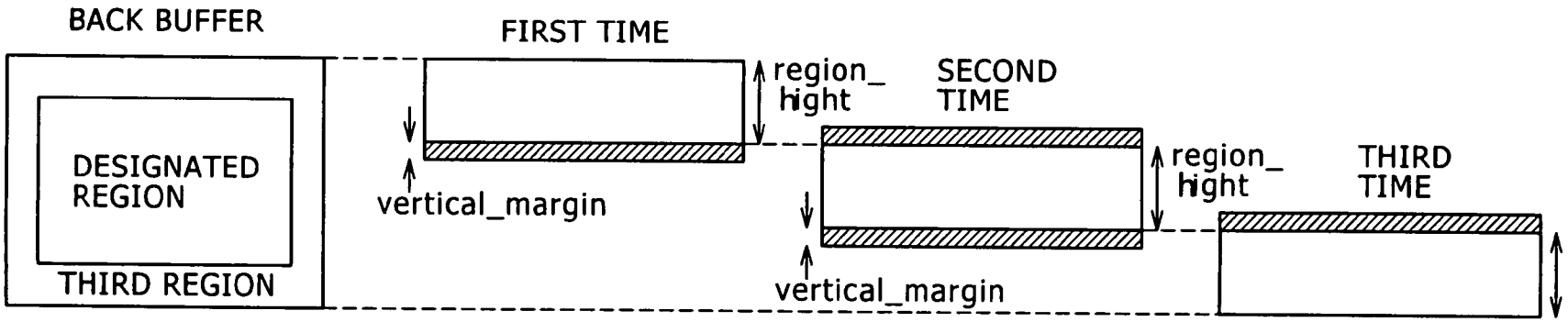
FIG. 9 is a diagrammatic view showing an expansion region added to a divisional region in divisional updating.

Also where a partial back buffer described hereinabove is used and divisional updating and expansion or reduction are combined in the front buffer 43, the region expansion for allowing use of integer coordinates, the region expansion for allowing use of filtering processing and the further region expansion for allowing use of integer coordinates are performed. In particular, a third expansion region is set for a designated rectangular region as a designated region as seen in FIG. 9.

Those image data which belong to the third expansion region set in this manner are transferred divisionally from the back buffer 34 to the image processing section working region 44. In this instance, a minimum value which satisfies the following conditions 3 and 4 is calculated as the height vertical_margin of the expanded portion which is a portion indicated by slanting lines in FIG. 9:

condition 3: vertical_margin≦filter_h condition 4: vertical_margin=align_y·n (n is a natural number).

In the conditions specified above, the definitions of the terms are such as given below:

filter_h: height necessary for the filtering process align_y: variable used for allowing use of integer coordinates It is to be noted that the maximum value of the height of the divisional region in the divisional updating, that is, region_height illustrated in FIG. 9, is calculated in accordance with the following descriptions:

Where an expansion or reduction process is not involved region_height=buf_size/row_bytes (with the fraction discarded)

Where an expansion or reduction process is involved region_height is a maximum value which satisfies the following conditions 5 and 6:

condition 5: region_height≦(buf_size/row_bytes (with the fraction discarded))−2vertical_margin condition 6: region_height=align_y·n (n is a natural number)

As described above, according to the image display apparatus 10 to which an embodiment of the present invention is applied, the image display application 31 can expand or reduce and/or rotate and display image data on the display unit 22 by storing the image data into the back buffer 34 and calling the APIs of the buffer control middleware 32.

Further, also where image data acquired from the outside such as the recording medium 21 are to be expanded or reduced and/or rotated and displayed on the display unit 22, the image display application 31 can directly store the acquired image data directly into the back buffer 34 without temporarily storing the image data into a temporary region.

While a preferred embodiment of the present invention has been described using specific terms, such description is for illustrative purpose only, and it is to be understood that changes and variations may be made without departing from the spirit or scope of the following claims.

What is claimed is:

1. A display control apparatus for causing an image corresponding to image data to be displayed on a display unit, comprising:

an execution section configured to execute an application program and middleware for controlling action of said display control apparatus;

a first retaining section configured to retain inputted image data having a first width and height;

a second retaining section configured to retain image data having a second width and height different from the first width and height;

an image processing section configured to perform an expansion process or a reduction process for image data read out from the first retaining section having the first width and height, the resulting image data having the second width and height and being stored to the second retaining section; and a reflection section configured to reflect the image data retained in said second retaining section on a display of the display unit;

said image processing section and said first and second retaining sections being controlled with an application program interface provided by the middleware and called by the application program.

2. The display control apparatus according to claim 1, wherein said image processing section performs a rotation process for the image data read out from said first retaining section.

3. The display control apparatus according to claim 1, wherein said image processing section calculates an expansion ratio for the expansion process or a reduction ratio for the reduction process based on sizes of said first and second retaining sections.

4. The display control apparatus according to claim 1, wherein said image processing section performs the image process for the image data read out partly from said first retaining section.

5. The display control apparatus according to claim 4, wherein a boundary of the image data read out partly from said first retaining section is determined in such a manner as to have integer coordinate values after the image process by said image processing section.

6. The display control apparatus according to claim 4, wherein a boundary of the image data read out partly from said first retaining section is determined taking a filtering process of pixels included in the image process by said image processing section into consideration.

7. The display control apparatus according to claim 1, wherein said first retaining section has a capacity smaller than an amount of the entire image data to be retained and retains the image data inputted divisionally from among the entire image data.

8. The display control apparatus according to claim 1, wherein said first retaining section is configured to retain inputted image data having a first number of pixels;

said second retaining section is configured to retain inputted image data having a second number of pixels; and said image processing section is configured to change a number of pixels in the inputted image data of the first retaining section having the first number of pixels to the second number of pixels of the inputted image data of the second retaining section.

9. A display control method for a display control apparatus which causes an image corresponding to image data to be displayed on a display unit, comprising the steps of:

receiving and retaining, by the display control apparatus, inputted image data in a first retaining section configured to retain inputted image data having a first width and height;

reading out the image data retained by the first retaining section and performing an image process including an expansion process or a reduction process for the image data;

secondly retaining image data of a result of the image process by the process at the image processing step in a second retaining section configured to retain image data outputted by the image process having a second width and height different from the first width and height; and reflecting the image data retained by the second retaining section on a display unit of the display apparatus;

the image processing step and the first and second retaining sections being controlled with an application program interface provided by middleware and called by an application program.

* * * * *